United States Patent [19]

Albrecht

[11] Patent Number: 4,932,911

[45] Date of Patent: Jun. 12, 1990

[54] HANDBOARDS

[76] Inventor: Douglas C. Albrecht, 3176 Huelani Dr., Honolulu, Hi. 96822

[21] Appl. No.: 383,805

[22] Filed: Jul. 21, 1989

[51] Int. Cl.[5] ..... A63B 21/00

[52] U.S. Cl. ..... 441/56; 441/58; 272/71

[58] Field of Search ..... 441/56, 58; 272/71, 272/116

[56] References Cited

U.S. PATENT DOCUMENTS

| | | | |
|---|---|---|---|
| 1,395,914 | 11/1921 | Grundman | 441/58 |
| 1,623,852 | 4/1927 | Pike | 441/58 |
| 2,159,972 | 5/1939 | Larson | 441/58 |
| 2,313,979 | 3/1943 | Tuma | 441/58 |
| 2,810,138 | 10/1957 | Cochran | 441/56 |
| 3,417,415 | 12/1968 | Kozak | 441/58 |
| 4,521,011 | 6/1985 | Solloway | 272/71 X |

*Primary Examiner*—Sherman D. Basinger
*Assistant Examiner*—Edwin L. Swinehart
*Attorney, Agent, or Firm*—Martin E. Hsia

[57] ABSTRACT

A handboard having a convex top, a flat base and a flat extended lip in which the convex top supports the user's hand in its natural partially cupped position during use, the flat base presents minimal forward resistance in use and the flat extended lip increases a swimmer's pulling area on a downstroke.

17 Claims, 4 Drawing Sheets

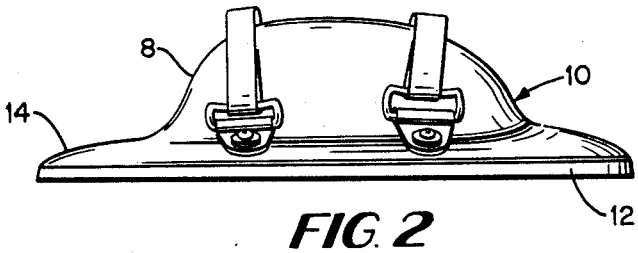
FIG. 2
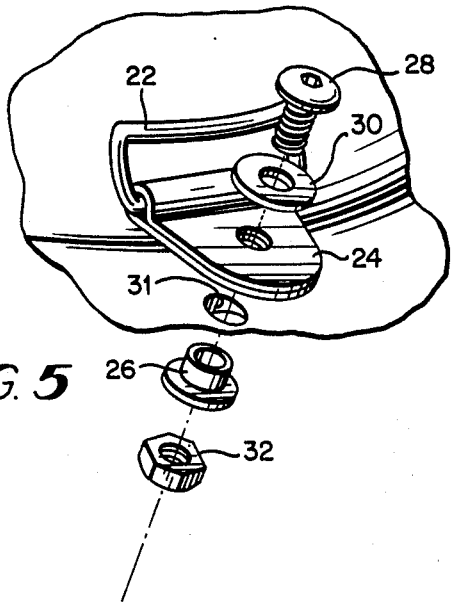
FIG. 5
FIG. 3
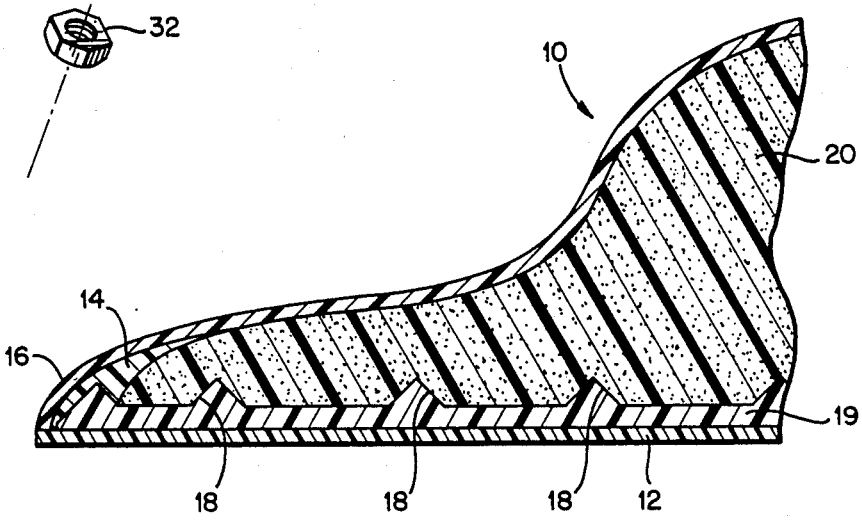
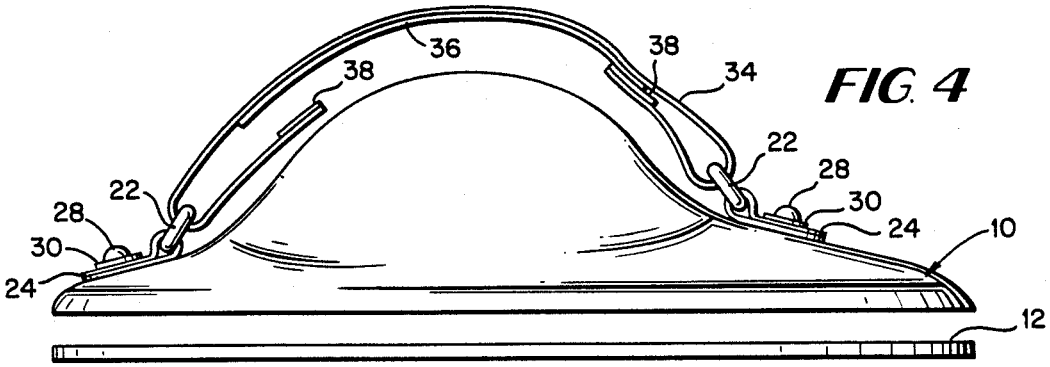
FIG. 4

HANDBOARDS

BACKGROUND OF THE INVENTION

This invention relates to swimming handboards, and in particular to wave-riding/speed-swimming handboards.

Bodysurfing is an ocean sport. It involves swimming in front of a wave until the wave "catches" the bodysurfer and pushes the bodysurfer along its front edge (the terms "swimmer" and "bodysurfer" are used interchangeably herein, but this invention is not limited to bodysurfing). Handboards are used in bodysurfing to aid the bodysurfer to catch waves and to maneuver on the waves.

A speed-swimming stroke is needed to catch the wave. Speed-swimming utilizes an armstroke that punches through the surface of the water and extends forward below the surface, then pulls straight back beneath the swimmer.

A number of handboards have been developed to aid swimmers. These hand paddles use a "pull from the surface of the water" style of armstroke. However, these prior handboards are ill-equipped for the speed-swimming arm stroke and increased speed required for body surfing.

As the speed of a bodysurfer increases, the force of the water on the bodysurfer increases. Devices with only a single band to hold the handboard on the bodysurfer's hand, such as disclosed in U.S. Pat. No. 3,417,415 to Kozak and U.S. Pat. No. 2,313,979 to Tuma, would catch their forward edges if forced into a flow of water and therefore would dive or stop. Large concave devices such as disclosed in U.S. Pat. No. 2,159,972 to Larson and U.S. Pat. No. 2,810,138 to Cochran also will dive upon entering the water and will not allow a swimmer's arm to extend fully in the forward direction. Because of their tendency to pull a swimmer surfer's arm downwards, the above described inventions are unsuitable for a speed-swimming stroke.

A device such as disclosed in U.S. Pat. No. 1,395,914 to Grundmann binds the hand to a flat piece, causing tension from the unnatural flattening, which shortens the time in use because of fatigue.

It is therefore an object of this invention to provide a handworn device that effectively increases the pulling area of the hand.

It is a further object of this invention to provide such a device that does not substantially increase the forward resistance of a swimmer's hand.

It is a still further object of this invention to provide such a device that allows the hand to remain in a comfortable, natural position during use so that the time in use can be maximized.

It is a still further object of this invention to provide a handboard that does not dive or dig down into the water when thrust forward into the water during a speed swimming stroke.

SUMMARY OF INVENTION

These and other objects of the invention are achieved by a handboard having a convex top and a flat bottom with a flat extended lip. The convex shape of the top supports the natural curve of a cupped hand. The flat extended lip extends beyond the palm of the hand, thus providing a greater surface with which to push against the water on the downstroke. The device is preferably attached to the hand by two straps, one across the knuckles of the fingertips and another behind the knuckles at the base of the fingers, leaving the thumb free.

The straps preferably position the handboards' convex top in the palm of the cupped hand. By filling the cupped hand with a supporting convex top, and fringing it with a flat extended lip, there is very little added forward resistance compared with a swimmer's normal hand shape, but a dramatic change in pulling area in the downstroke. This gives the swimmer much the same feeling when entering and extending the hand during the forward extension portion of a speed swimming stroke, but much more water to pull with. The swimmer therefore can use this device at higher speed than prior devices and still have a controlled arm extension.

Because of the convex top and flat bottom of the device, the convex top is pushed into the palm of the hand during the forward portion of the speed swimming stroke, much as a foil with a convex top and a flat bottom is lifted when moving horizontally through a fluid. Because the bottom of the device is flat, the device also does not dive or force the swimmer's hand downwards, as would be the case with prior devices having concave bottoms.

BRIEF DESCRIPTION OF THE DRAWINGS

FIG. 2 is a right side elevational view of the preferred embodiment of the handboards of the present invention.

FIG. 3 is a partial front cut-away view of the preferred embodiment of the handboards of the present invention.

FIG. 4 is a front elevational view of the preferred embodiment of the handboards of the present invention.

FIG. 5 is an exploded view of the buckles of the preferred embodiment of the present invention.

DESCRIPTION OF THE PREFERRED EMBODIMENT OF THE INVENTION

Figure 1:
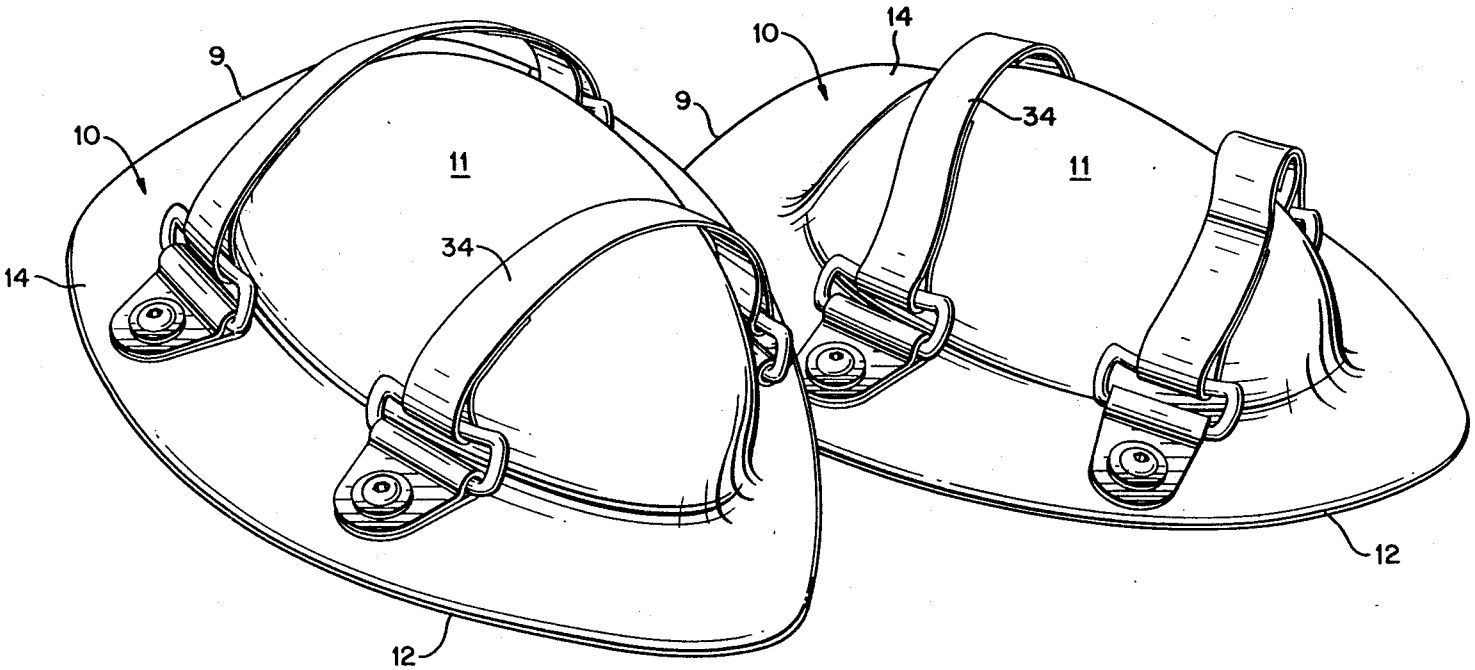
FIG. 1 is a perspective view of the preferred embodiment of the handboards of the present invention.

Referring to FIGS. 1 and 2, the handboard 9 of the preferred embodiment of the invention includes a top 10 having a hump 11 and a base 12 with handstraps 34 attached to the top 10. The top 10 and base 12 are preferably made of resin laminated cloth, 2 or more ply in thickness. These are molded into shape. The top 10 is preferably contoured with a resin putty coat 14 around the border. The base 12 is molded flat and cut to size.

Referring to FIG. 3, the top 10 is preferably filled with a polyurethane foam 20, and shaved flat. The base 12 is preferably attached to the foam 20 by a resin paste 19. Increased rigidity is attained by furrowing the bottom surface of the foam 20 with grooves 18. The edge where the top 10 and the base 12 meet is preferably sealed with a coat of resin 16.

Referring to FIG. 4, the handstraps 34 are looped through plastic links 22 affixed to the top 10. The handstraps 34 are preferably constructed from ¼" to 1" wide nylon or similar material. Preferably, the loop element 36 of a hook and loop fastener, such as VELCRO ®, is attached to the center 36 of a handstrap 34, and hook elements 38 of the hook and loop fastener are sewn at each end. The loop element 36 faces the top 10, the ends of the handstrap 34 are looped under and through the plastic link 22, and the hook elements 38 are attached to the loop element 36 in the center of the handstrap 34.

Referring to FIG. 5, the plastic link 22 preferably is attached to a fold-over buckle base 24 which is attached to the top 10 by a stainless steel tamper-resistant machine-screw 28 that passes through a washer 30 and through a hole 31 in the top 10. The machine-screw 28 then extends through a flanged nylon collar 26 and is held with a stainless steel nut 32.

Figure 6:
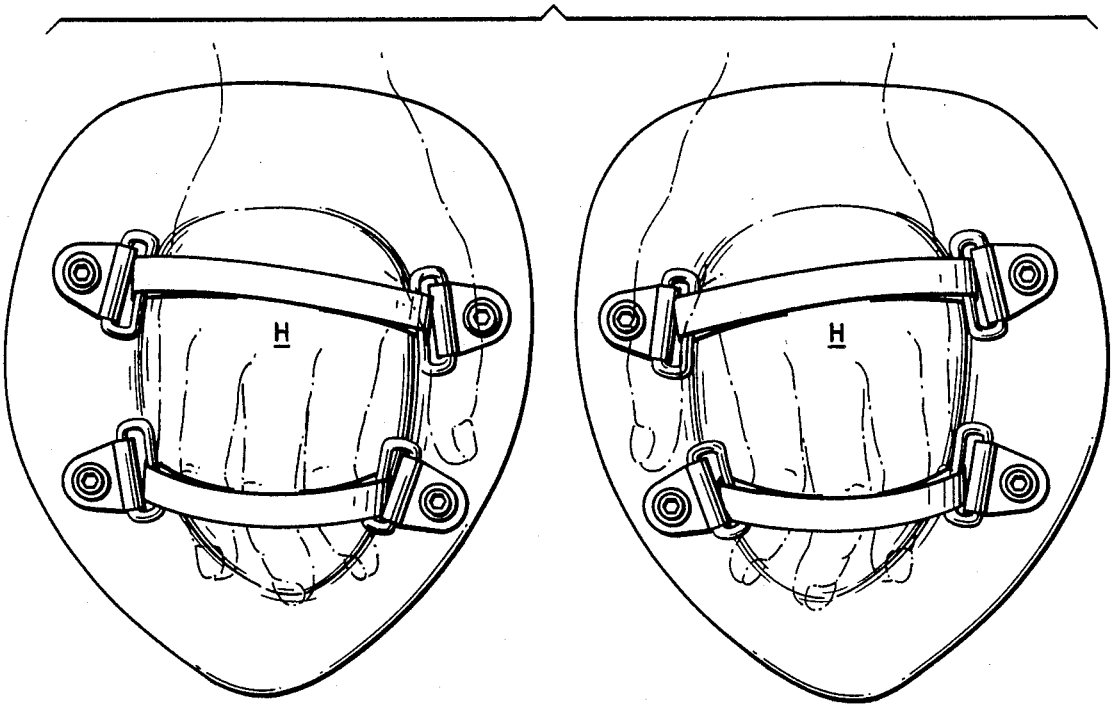
FIG. 6 is a top plan view of the preferred embodiment of the handboards of the present invention, with the hands of a user shown.
Figure 7:
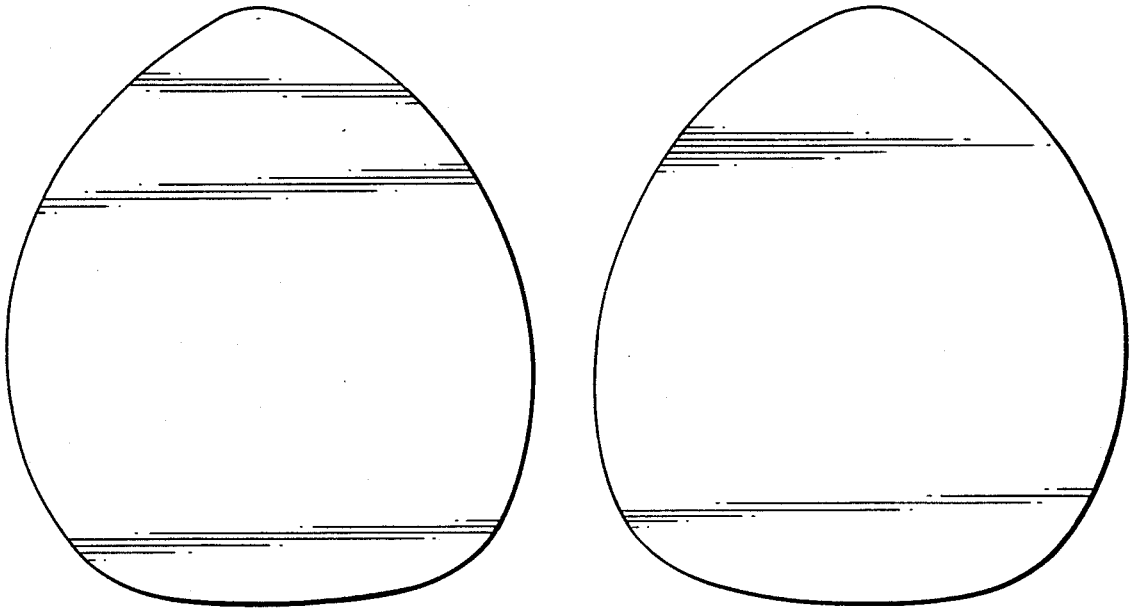
FIG. 7 is a bottom plan view of the preferred embodiment of the handboards of the present invention.

Referring to FIGS. 6 and 7, the tops 10 and the bases 12 of the left and right handboards 9 preferably are asymmetric to conform roughly to the outlines of the left and right hand with an added flat lip extending outwardly from the outside of each hand. The humps 11 are also preferably asymmetrically located on the tops 10 so that the palms of the hands of the swimmer H are centered on the handboards 9.

The preferred shape of the base 12 of the handboards 9 is an extremely rounded isosceles triangle, where the base of the triangle roughly corresponds to the base of the hand and the two equal sides roughly correspond to the left and right sides of the hand, with all corners extremely rounded. Of course, the bases 12 of the handboards can be any other shape, such as a non-isosceles triangle, an oval, a circle, a square or a rectangle.

Figure 8:
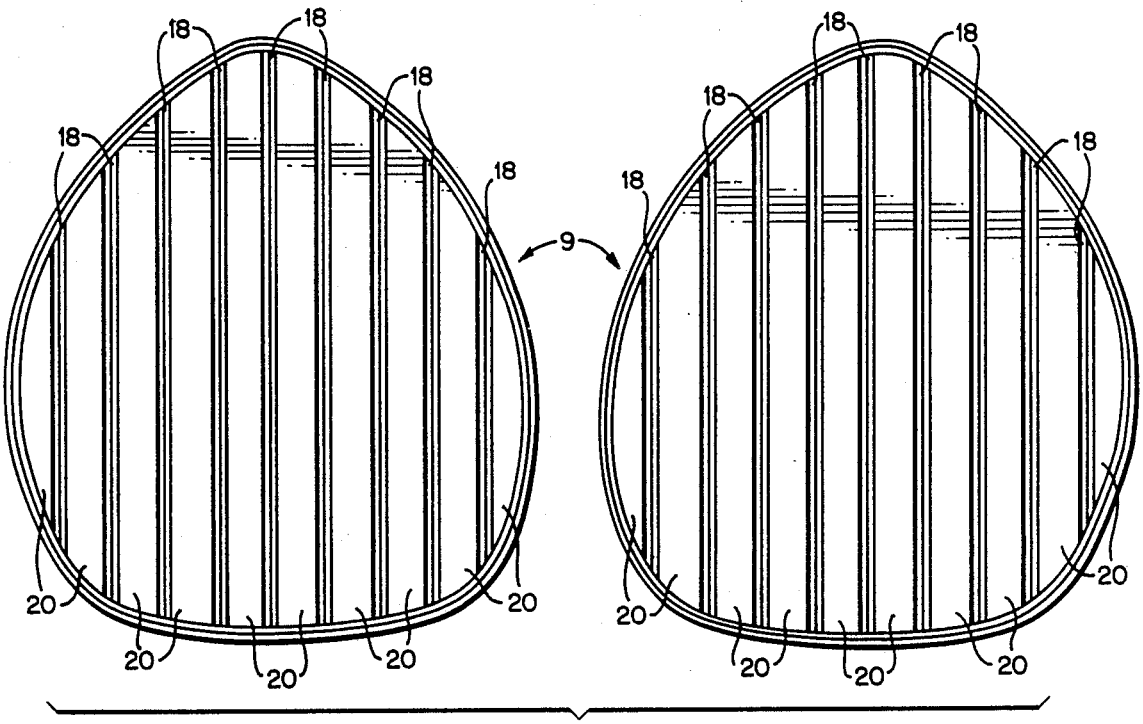
FIG. 8 is a bottom cut-away view of the preferred embodiment of the handboards of the present invention.

Referring to FIG. 8, the grooves 18 in the foam 20 extend from the front to the back of the handboards 9, and also extend around the border of the bottom surface of the foam 20, interlocking at the border.

The invention has been described with respect to a particular preferred embodiment. It will be obvious to those skilled in the art that changes and modifications can be made to the embodiment described above without departing from the scope and spirit of the invention. For example, the handboards could be made using different materials, such as molded plastic, polyurethane foams, resins of different types or cloth of a different thread. The handboards also can be made by combining natural shaped woods or by shaping woods. The tops 10 can have a variety of shapes and cross sections, with symmetric humps, symmetric fringing lips, asymmetric humps or asymmetric lips. Further, the humps need not be smooth and continuous; sections of the humps can be cut out to reduce mass, for example, by cutting out parts of the hump under the palm portion that are not necessary for supporting the palm in its natural cupped position. As indicated above, the base 12 can also be a variety of shapes, such as a non-isosceles triangle, a circle, an oval, a square or a rectangle. The handboard could also be integrally molded, using foam or any of the other materials described above. The device also can be made from other combinations of the materials described above, such as a plastic base with a foam hump, or a plastic hump with a wood base. Further, the plastic links in the buckles can be made of stainless steel. The machine screws that hold the base of the buckles to the top can be changed to rivets, or plastic pieces of equal strength. Accordingly, no limitations are to be inferred in the scope of the invention except as set forth in the attached claims.

What is claimed is:

1. A handboard, comprising:

a generally convex top having a palm portion and a finger portion; and a substantially flat base attached to said top, wherein said convex top includes a hump portion in said palm portion and in a rearward part of said finger portion, wherein said convex top further comprises;

a substantially flat lip portion extending away from said hump portion and tapering towards said base.

2. A handboard, according to claim 1, wherein said hump is positioned on said handboard to substantially center a user's palm on said handboard.

3. A handboard, according to claim 1, wherein said base is substantially shaped like an extremely rounded isosceles triangle.

4. A handboard, according to claim 1, wherein said convex top has a hollow portion.

5. A handboard, according to claim 4, further comprising foam substantially filling said hollow portion.

6. A handboard, according to claim 5, wherein said foam comprises polyurethane foam.

7. A handboard, according to claim 1, wherein said top comprises resin laminated cloth.

8. A handboard, according to claim 1, wherein said base comprises resin laminated cloth.

9. A handboard according to claim 1, further comprising:

a finger strap attached to a leftward part of said finger portion, extending across said finger portion and attached to a rightward part of said finger portion.

10. A handboard according to claim 9, further comprising:

a palm strap attached to a leftward part of said palm portion, extending across said palm portion and attached to a rightward part of said palm portion.

11. A handboard, according to claim 17, further comprising a loop element of a hook and loop fastener attached to a central portion of each of said straps and a hook element of a hook and loop fastener attached to each of the ends of each of said straps.

12. A handboard, according to claim 3, further comprising:

a right finger portion buckle attached to a right part of said finger portion;

a left finger portion buckle attached to a left part of said finger portion; and a finger portion strap attached to said right finger portion buckle and said left finger portion buckle, said finger portion strap comprising:

a right finger portion strap having a first end and a second end, said first end of said right finger portion strap being adjustably buckled to said right finger portion buckle;

a left finger portion strap having a first end and a second end, said first end of said left finger portion strap being adjustably buckled to said left finger portion buckle; and said second end of said right finger portion strap being adjustably attached to said second end of said left finger portion strap.

13. A handboard, according to claim 12, further comprising:

a right palm portion buckle attached to a right part of said palm portion;

a left palm portion buckle attached to a left part of said palm portion; and a palm portion strap attached to said right palm portion buckle and said left palm portion buckle, said palm portion strap comprising:

a right palm portion strap having a first end and a second end, said first end of said right palm portion strap being adjustably buckled to said right palm portion buckle;

a left palm portion strap having a first end and a second end, said first end of said left palm portion strap being adjustably buckled to said left palm portion buckle; and said second end of said right palm portion strap being adjustably attached to said second end of said left palm portion strap.

14. A handboard, according to claim 12, wherein at least one of said buckles is attached to said top by a screw.

15. A handboard, according to claim 14, further comprising a nut attached to said screw.

16. A handboard, according to claim 1, wherein: said top and said base are integrally formed.

17. A handboard, according to claim 16, wherein said handboards are integrally formed of a material selected from the group consisting of wood, plastic, resin laminated cloth and metal.

* * * * *